United States Patent [19]

Holland

[11] Patent Number: 4,568,584

[45] Date of Patent: Feb. 4, 1986

[54] GARDEN STRUCTURE

[76] Inventor: Don A. Holland, 608 Bluebird La., Livingston, Mont. 59047

[21] Appl. No.: 673,395

[22] Filed: Nov. 20, 1984

[51] Int. Cl.[4] ..... B32B 3/14; E01C 15/00

[52] U.S. Cl. ..... 428/44; 428/60; 428/61; 428/76; 52/177; 52/582; 52/588; 404/35; 404/40; 404/41

[58] Field of Search ..... 428/44, 53, 54, 52, 428/60, 76, 61; 404/35, 40, 41; 52/177, 578, 582, 588

[56] References Cited

U.S. PATENT DOCUMENTS 4,152,875 5/1979 Soland ..... 404/35 X

*Primary Examiner*—Alexander S. Thomas
*Attorney, Agent, or Firm*—Arthur L. Urban

[57] ABSTRACT

A garden structure includes a plurality of adjacent plastic base members with each of the base members including a frame portion, a filler portion, a sealing portion and a fastening portion. The frame portion includes spaced substantially flat major sections, sections having substantially the same configuration and being disposed substantially parallel to each other. Sidewall sections extend between adjacent peripheral edges of the major sections and at least two opposed sidewall sections are substantially parallel to each other throughout their lengths. The spaced major sections and sidewall sections together form a cavity within the base member. The filler portion includes particulate material compressed within the cavity of the base member and filling same. The sealing portion includes an opening in one sidewall of the base member and a cover section engageable with and completely enclosing the opening. The fastening portion includes securing mechanism disposed adjacent the opposed parallel sidewall sections. Base members filled with particulate material through the opening therein and sealed with the cover section are positioned with the opposed sidewall sections closely adjacent to each other and are maintained in this relationship through the fastening portion to form the garden structure.

16 Claims, 7 Drawing Figures

GARDEN STRUCTURE

This invention relates to a novel structure and more particularly relates to a new garden structure.

Throughout history, people with gardens have developed paths through the planted material to provide access into the interior. Plants may be arranged in spaced rows with the space between the rows affording the required access. These paths may be simple open dirt areas which are tamped down by the traffic thereon.

In more formal gardens, the paths may be defined better with a particulate material such as gravel. However, gravel paths or walks can present problems since the gravel is carried on shoes to surrounding areas and even into buildings such as houses.

To eliminate the problems encountered with gravel and other particulate materials, people have employed materials which were larger in mass. Bricks, flat stones and the like have been combined to provide pathways and other hard surface areas such as walks, patios, etc. Although such hard surface materials provide satisfactory results, they are not without shortcomings. For example, they may have limited availability and thus can be very expensive.

As a substitute for brick and stone, people have used poured concrete. However, concrete requires special finishing which cannot be performed successfully by most homeowners. Even when an individual is willing to attempt the placement of wet concrete, a great deal of time and effort is required for the preparation, placement and finishing. Furthermore, the concrete itself is very heavy and may have to be moved in carts or wheelbarrows from the mixer or truck to the job site.

An alternative to concrete is the use of preformed concrete blocks. Such blocks are sold in various sizes to accommodate the needs of the homeowner. Generally, the blocks are two to four inches thick with a relatively large surface area. Even though many of the problems of handling wet concrete are eliminated, the use of preformed blocks is not without its own problems. The blocks are heavy and a homeowner must be in good physical shape to handle any significant number without fatigue and/or straining of the body.

From the above, it is clear that the use of concrete whether wet or in preformed configurations involves the handling of very heavy materials. This weight problem also is present with other conventional hard surface materials such as brick and stone, even though the individual pieces may be smaller in size. Thus, these conventional materials cannot be handled successfully by persons with limited physical strength and stamina.

Since many persons including those of middle age and beyond as well as most women and youngsters fall into this category, a large part of the population is not able to construct garden structures such as pathways and patios by themselves. As a result, individuals are faced with a dilemma. Either they can hire the job done professionally at a high cost or they can seek volunteer assistance or they can contend with the shortcomings inherent in gravel areas.

These alternatives may present major compromises from the solution which a homeowner actually desires. Thus, there is a need for a new garden structure that overcomes the deficiencies of previous expedients.

The present invention provides a novel garden structure with features and advantages not found in conventional structures. The garden structure of the invention enables persons of limited physical strength and stamina to construct hard surface walks, patios and the like without assistance from others.

Through the use of the garden structure of the invention, individuals who normally would not be able to construct walks and patios themselves can now do this alone simply and quickly. The garden structural units of the invention are light in weight and can be handled easily by persons of all ages including the elderly. As a result, the assembly thereof can be accomplished without physical strain or injury to the body.

The garden structure of the present invention is simple in design and can be produced relatively inexpensively. The structure can be fabricated from commercially available materials and components. Conventional manufacturing methods and procedures and semi-skilled labor can be utilized in its production.

The garden structural units of the invention can be produced in a wide variety of different designs. Also, the structures can be assembled in many different ways to provide unique effects. These results can be achieved easily and conveniently. The structure can be assembled at a rate and time that suits the user. The user can extend the job or expedite it as he desires rather than be tied to a rigid schedule dictated by the material being employed.

These and other benefits and advantages of the novel garden structure of the present invention will be apparent from the following description and the accompanying drawings in which.

Figure 1:
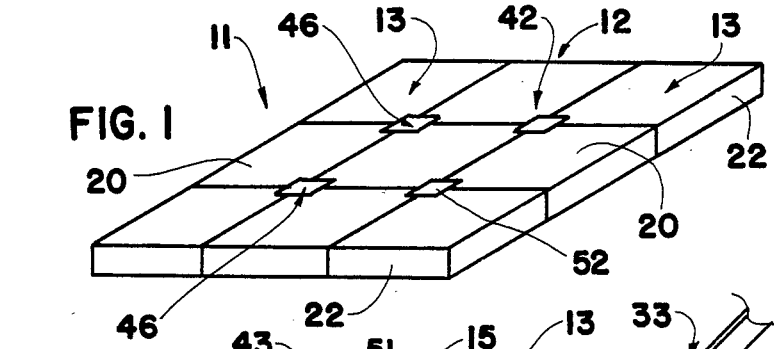
FIG. 1 is a view in perspective of one form of the garden structure of the invention assembled.

As shown in the drawings, one form of the novel garden structure 11 of the present invention is assembled in the form of a patio 12. The garden structure 11 of the invention includes a plurality of adjacent plastic base members 13. Each base member 13 includes a frame portion 15, a filler portion 16, a sealing portion 17 and a fastening portion 18.

Each frame portion 15 of a base member 13 includes spaced substantially flat major sections 20 and 21. The spaced major sections 20 and 21 have substantially the same configuration and are disposed substantially parallel to each other. Advantageously, the major sections 20 and 21 have a wear resistant outer surface. The major sections also preferably have a generally quadrangular configuration.

The frame portion 15 also includes sidewall sections 22. The sidewall sections extend between adjacent peripheral edges such as edges 23 and 24 of the major sections 20 and 21. At least two opposed sidewall sections are substantially parallel to each other throughout their lengths. This arrangement permits adjacent base members 13 to be assembled in a tight pattern with a minimum of space therebetween.

The spaced major sections 20 and 21 and the connecting sidewall sections 22 together form a cavity 25 within the base member 13. The major sections and the sidewall sections advantageously are of sheet configuration. Preferably, the major sections 20 and 21 and the sidewall sections 22 form a unitary structure. It is desirable that the base members be molded plastic structures.

Figure 3:
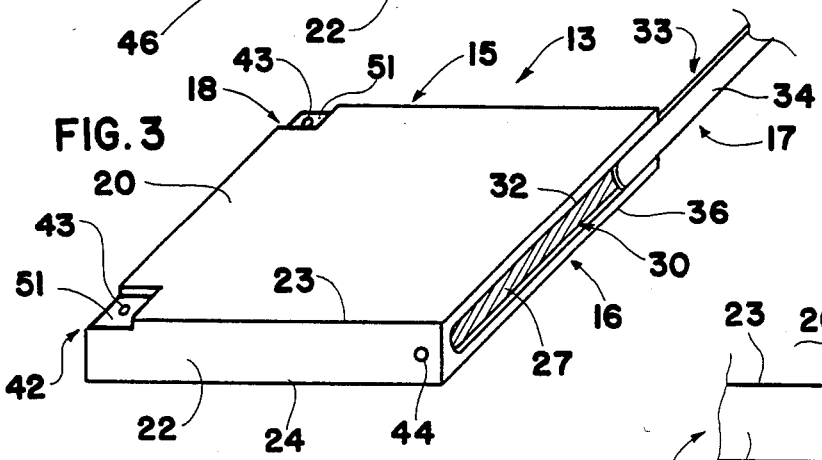
FIG. 3 is an enlarged view in perspective of a single garden structural unit shown in FIG. 1.
Figure 6:
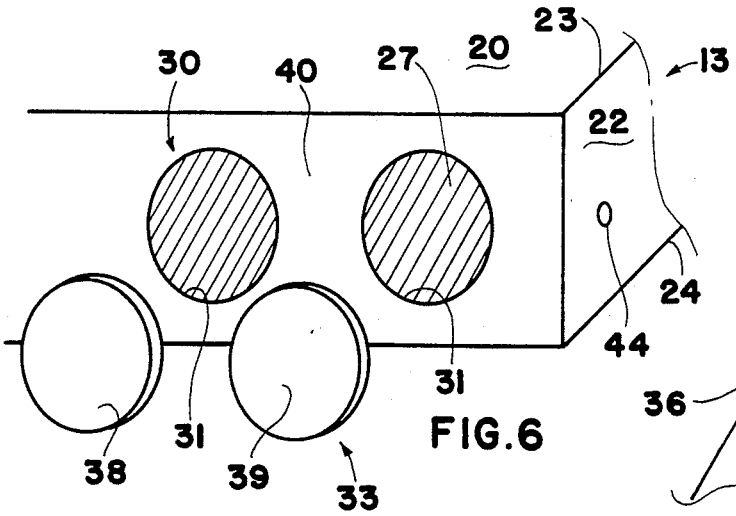
FIG. 6 is a fragmentary view in perspective of another form of the sealing portion of the garden structure of the invention.

The filler portion 16 of each base member 13 includes particulate material 27. The particulate material is compressed within cavity 25 of the base member and fills it as shown in FIGS. 3 and 6. The particulate material may be common soil or advantageously may be material such as sand, gravel or the like.

Figure 7:
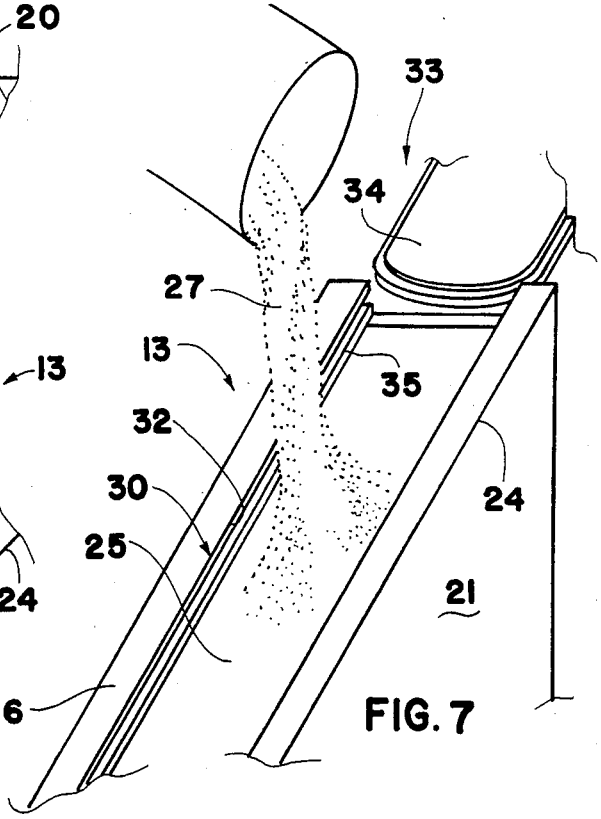
FIG. 7 is a fragmentary view illustrating the addition of filler portion of the garden structural unit shown in FIG. 3.

The sealing portion 17 of the base members of the garden structure 11 of the invention includes an opening 30 in one sidewall of the base member. The opening 30 may include several openings 31 as shown in FIG. 6. Advantageously, the opening is an elongated slot 32 as shown in FIGS. 3 and 7.

The sealing portion 17 also includes a cover section 33. The cover section is engageable with the opening 30. The cover section completely encloses the opening. In FIGS. 3 and 7, the cover section is shown as a sliding section 34 that moves along grooves 35 in the sidewall section 36. FIG. 6 illustrates cover sections 38 and 39 that snap into openings 31 in the sidewall 40.

Figure 2:
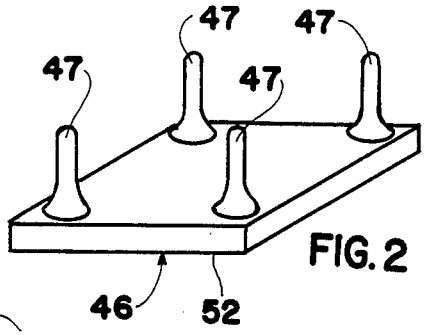
FIG. 2 is an enlarged view in perspective of the fastener portion shown in FIG. 1 in an inverted position.
Figure 4:
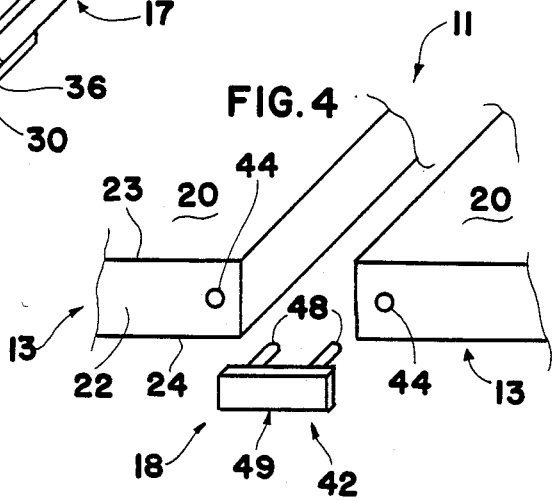
FIG. 4 is an enlarged fragmentary view in perspective of another form of the fastener portion of the garden structure of the invention.

The fastening portion 18 of the garden structure 11 includes securing means 42. The securing means 42 is disposed adjacent opposed parallel sidewall sections. FIGS. 1–3, 4 and 5 illustrate three different securing means 42. In FIGS. 1–3 and 4 the fastening means includes recesses. FIGS. 1–3 show the recesses 43 located adjacent corners of the major section 20. In FIG. 4, recesses 44 are located near the ends of the sidewall sections 22.

The fastening portion 18 also includes connector members with male sections. In FIGS. 1–3, connector members 46 (shown in detail in FIG. 2) include four male sections 47. Each male section 47 is mateable with a recess 43 at a corner of the base member. Thus, the four male sections engage the four recesses that adjoin each other in the garden structure 11 shown in FIG. 1. Similarly, male sections 48 of connector members 49 (FIG. 4) engage recesses 44 in the sidewalls of the adjoining base members.

To provide a smooth common upper surface between adjoining base members, depressed areas 51 surround each recess 43. Four of the depressed areas together are the same size as the upper major surface 52 of the connector member 46. With this arrangement, the upper surfaces of the connector members 46 lie in the same plane as the upper surfaces of the adjoining major sections 20.

Figure 5:
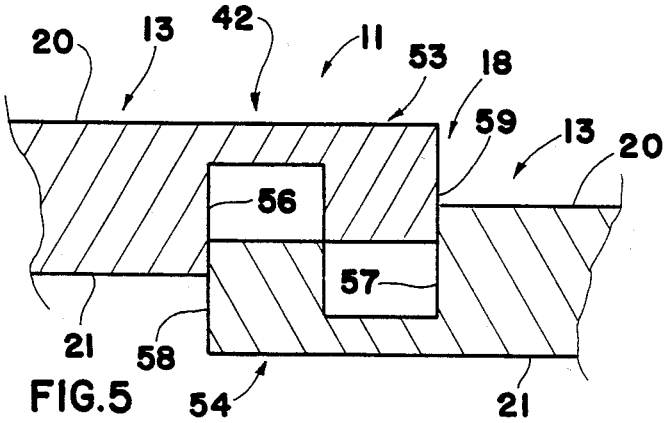
FIG. 5 is an enlarged fragmentary side view in section of a further form of the garden structure of the invention.

In FIG. 5, the fastening portion 18 includes interlocking cutout sections 53 and 54. The cutout sections 53 and 54 include grooves 56 and 57 with which hooks 58 and 59 interlock or mate. When the cutout sections 53 and 54 are completely interlocked, the major surfaces 20 of the base members are disposed in the same plane and thereby provide a common smooth surface.

The garden structure of the present invention, as pointed out above, includes a plurality of plastic base members. Advantageously, the base members are molded plastic structures formed by conventional molding methods such as injection molding, blow molding and the like. The base members as well as the connector members may be formed of any of a wide variety of plastic materials such as polyamides, polyesters, polyvinyls, polyolefins, polyacrylics and similar materials as well as combinations thereof. The outer surfaces of the major sections advantageously are formed of wear resistant materials such as polyamides, polyesters, polyvinyls, ultrahigh molecular weight polyolefins, etc. The particular plastics selected will be determined by the specific end use and the relative selling price of the product.

The above description and the accompanying drawings show that the present invention provides a novel garden structure with advantages and features not found in previous structures. The structural units of the present invention are light in weight and can be handled easily by persons of all ages. As a result, individuals with limited strength and stamina can assemble the garden structure of the invention without assistance from others.

The garden structure of the invention is simple in design and can be produced relatively inexpensively from commercially available materials and components using conventional plastic fabricating procedures. The garden structure can be produced in a wide variety of designs. The garden structure can be assembled in different ways to achieve unique effects. The garden structure can be assembled slowly or rapidly as desired by the user rather than on a schedule dictated by the characteristics of the product.

It will be apparent that various modifications can be made in the particular garden structure described in detail and shown in the drawings within the scope of the invention. The size, configuration and arrangement of components can be changed to meet specific requirements. The sealing portion may include adhesive materials to affix the cover section to the filler opening. Also, a wear resistant layer or film may be laminated to the major sections to improve the durability of the product. Likewise, the base members may be employed as separate units spaced from one another if desired. Similarly, the base members may be utilized as decorative items rather than for utilitarian purposes. These and other changes can be made in the garden structure of the invention provided the function and operation thereof are not adversely affected. Therefore, the scope of the present invention is to be limited only by the following claims.

What is claimed is:

1. A garden structure including a plurality of adjacent plastic base members; each of said base members including a frame portion, a filler portion, a sealing portion and a fastening portion; said frame portion including spaced substantially flat major sections, said spaced major sections having substantially the same configuration and being disposed substantially parallel to each other, sidewall sections extending between adjacent peripheral edges of said major sections, at least two opposed sidewall sections being substantially parallel to each other throughout their lengths, said spaced major sections and said sidewall sections together forming a cavity within said base member; said filler portion including particulate material compressed within said cavity of said base member and filling same; said sealing portion including an opening in one sidewall of said base member and a cover section engageable with and completely enclosing said opening; said fastening portion including securing means disposed adjacent said opposed parallel sidewall sections; whereby base members filled with particulate material through said opening therein and sealed with said cover section are positioned with said opposed sidewall sections closely adjacent to each other and are maintained in this relationship through said fastening portion to form said garden structure.

2. A garden structure according to claim 1 wherein said major sections and said sidewall sections of said base member are of sheet configuration.

3. A garden structure according to claim 1 wherein said major sections and said sidewall sections form a unitary structure.

4. A garden structure according to claim 1 wherein said base member is a molded plastic structure.

5. A garden structure according to claim 1 wherein said major sections have a wear resistant outer surface.

6. A garden structure according to claim 1 wherein said major sections of said base member have a generally quadrangular configuration.

7. A garden structure according to claim 1 wherein said particulate material of said filler portion is soil.

8. A garden structure according to claim 1 wherein said particulate material of said filler portion is sand.

9. A garden structure according to claim 1 wherein said opening in said base member is an elongated slot.

10. A garden structure according to claim 1 wherein said cover section is of a configuration retainably engaged with said opening.

11. A garden structure according to claim 1 wherein said fastening portion includes interlocking cutout sections in said opposed parallel sidewall sections.

12. A garden structure according to claim 1 wherein said fastening means includes recesses in said major or sidewall sections and connector members with male sections mateable with said recesses.

13. A garden structure according to claim 12 wherein said recesses are disposed adjacent corners of said major sections.

14. A garden structure according to claim 12 wherein said recesses are disposed near the ends of said sidewall sections.

15. A garden structure according to claim 12 wherein said connector members include two male sections.

16. A garden structure according to claim 12 wherein said connector members include four male sections.

* * * * *